US010279497B2

(12) United States Patent
Jones et al.

(10) Patent No.: US 10,279,497 B2
(45) Date of Patent: May 7, 2019

(54) CUTTING APPARATUS EMPLOYING A MAGNET

(71) Applicants: Robert E. Jones, College Place, WA (US); Kenneth G. Carambot, Milton-Freewater, OR (US); Louis D. Jausoro, Walla Walla, WA (US)

(72) Inventors: Robert E. Jones, College Place, WA (US); Kenneth G. Carambot, Milton-Freewater, OR (US); Louis D. Jausoro, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 258 days.

(21) Appl. No.: 15/220,628

(22) Filed: Jul. 27, 2016

(65) Prior Publication Data

US 2018/0029247 A1 Feb. 1, 2018

(51) Int. Cl.

| | |
|---|---|
| ***B26D 1/11*** | (2006.01) |
| ***B26D 1/36*** | (2006.01) |
| ***B26D 5/12*** | (2006.01) |
| ***B26D 7/00*** | (2006.01) |
| ***B26D 7/26*** | (2006.01) |

(52) U.S. Cl.

CPC ..... *B26D 5/12* (2013.01); *B26D 1/11* (2013.01); *B26D 1/36* (2013.01); *B26D 7/0006* (2013.01); *B26D 7/26* (2013.01); *B26D 2210/02* (2013.01)

(58) Field of Classification Search

CPC ..... B26D 5/12; B26D 7/0006; B26D 1/36; B26D 1/11; B26D 2210/02; B26D 1/0006; B26D 2001/002; B26D 2001/006; B26D 7/22; B26D 7/26; G01V 15/00; Y10T 83/04; Y10T 83/089; Y10T 83/4705; Y10T 83/4812

See application file for complete search history.

(56) References Cited

U.S. PATENT DOCUMENTS

| | | | | |
|---|---|---|---|---|
| 3,765,286 A | | 10/1973 | Vossen | |
| 4,520,702 A | * | 6/1985 | Davis | B26D 5/007 83/76.8 |
| 4,656,904 A | | 4/1987 | Rayment | |
| 5,029,502 A | | 7/1991 | Irie | |
| 5,029,504 A | | 7/1991 | Wilber | |
| 5,230,271 A | | 7/1993 | Hardisty et al. | |
| 5,235,880 A | * | 8/1993 | Wilbur | B26D 1/0006 83/13 |
| 5,447,086 A | | 9/1995 | Wittmaier et al. | |

(Continued)

OTHER PUBLICATIONS

Notification of Transmittal of the International Search Report and the Written Opinion of the International Searching Authority, dated Apr. 17, 2017.

*Primary Examiner* — Jonathan G Riley

(74) *Attorney, Agent, or Firm* — Randall Danskin P.S.

(57) ABSTRACT

A cutting apparatus is disclosed which includes a cutter knife which is reciprocally moveable along a path of travel; a track member mounted adjacent to the cutter knife and which mechanically cooperates with the cutter knife so as to define, at least in part, a first non-cutting position, and a second cutting position for the cutter knife; and a magnet is mounted in a location on the track member and which releasably, magnetically restrains the cutter knife when the cutter knife is in the first non-cutting position.

22 Claims, 6 Drawing Sheets

(56) References Cited

U.S. PATENT DOCUMENTS

| | | | | |
|---|---|---|---|---|
| 6,782,883 | B2 | 8/2004 | Chen et al. | |
| 7,051,632 | B2 | 5/2006 | Hamilton et al. | |
| 7,430,947 | B2 | 10/2008 | Julian et al. | |
| 7,748,303 | B2 | 7/2010 | Julian et al. | |
| 7,789,000 | B2 | 9/2010 | Julian et al. | |
| 7,849,771 | B2 | 12/2010 | Julian et al. | |
| 8,978,530 | B2 | 3/2015 | Jones et al. | |
| 2004/0094006 | A1* | 5/2004 | McGarvey | B26D 1/42 83/303 |
| 2004/0094010 | A1 | 5/2004 | Chen et al. | |
| 2005/0279228 | A1 | 12/2005 | Julian et al. | |
| 2008/0302227 | A1 | 12/2008 | Viljanen | |
| 2009/0126549 | A1 | 5/2009 | Dietz et al. | |
| 2011/0079129 | A1 | 4/2011 | Fuchs et al. | |
| 2011/0179925 | A1 | 7/2011 | Brown et al. | |
| 2011/0296969 | A1 | 12/2011 | Lenzotti | |
| 2012/0266730 | A1* | 10/2012 | Jones | B26D 1/11 83/563 |
| 2012/0325067 | A1 | 12/2012 | Yamada et al. | |
| 2016/0136829 | A1* | 5/2016 | Calvert | B26D 1/0006 83/697 |

* cited by examiner

CUTTING APPARATUS EMPLOYING A MAGNET

TECHNICAL FIELD

The present invention relates to a cutting apparatus which is employed in connection with equipment for detecting defects in elongated articles, and for cutting the defects from the articles as the articles are being processed in a high output production facility.

BACKGROUND OF THE INVENTION

The present invention as disclosed in the paragraphs which follow can be employed in connection with an inspection and cutting apparatus such as what is shown in U.S. Pat. No. 4,520,702. The contents of this previous patent is incorporated by reference herein. U.S. Pat. No. 4,520,702 addressed a perceived problem then existing in the industry relative to the processing of elongated articles such as sliced potatoes utilized for frozen French fries, and wherein the elongated articles were first aligned in transversely spaced lanes and then passed beneath individual lane electro-optical cameras for inspecting the sliced potatoes for defects. In the previous prior art arrangements, if defects were encountered in the sliced potatoes one or more knives on a rotating wheel was projected or propelled from the wheel to cut the defect from the article. Various earlier U.S. patents such as U.S. Pat. Nos. 3,543,035 and 3,664,337 describes such earlier devices. These prior art devices were deemed to be not very effective because it was very difficult to process large volumes of product utilizing the equipment illustrated in these previous prior art patents. U.S. Pat. No. 4,520,702 also describes various other prior art attempts to solve the perceived limitations on the processing of elongated articles that might have defects. The inventors in U.S. Pat. Nos. 4,520,702 and 6,923,028, for example, describe an invention which provides high volume inspection and cutting for removing defects from elongated articles with resulting equipment that is quite inexpensive and robust relative to its production capacity.

The device as shown in U.S. Pat. No. 4,520,702 for example has been widely embraced by the food processing industry and has operated with a great degree of success through the years. While this apparatus as described in this prior art patent has operated quite reliably for several decades. there have been several shortcomings which have detracted from its usefulness. The first shortcoming that has been noted, and only occasionally, individual cutter knives employed in the apparatus as described, above, and when rotated at predetermined operational speeds occasionally would prematurely move and then be ejected to a radially, outwardly disposed orientation, and thereafter engage the elongated food product being processed without first being deployed by the cutting apparatus. This premature deployment of a cutting knife to the radially extended cutting position could occasionally cause the cutting knife to undesirably cut the sliced potatoes and/or become damaged. In addition to the foregoing the cutting knives employed to date have been fabricated from a synthetic material and due to normal wear and tear, and routine operating conditions, such prior art cutting knives or blades would occasionally break and needed to be replaced. This type of wear related failure is expected from time-to-time in devices of this type. However, depending upon the product to be cut, and inspected, such replacement of the cutting knives can sometimes be time consuming and inconvenient during typical food processing plant operations.

To address the perceived shortcomings as noted above, a cutting apparatus employing a magnet was developed and deployed in the field and is now fully disclosed and seen in U.S. Pat. No. 8,978,530. This particular cutting apparatus includes a cutter knife which is reciprocally moveable along a path of travel, and wherein the cutting knife is reliably held and then deployed from a retracted position, to an extended position, and then held in an appropriate orientation by the use of a magnet as described in that reference. While the device as illustrated and disclosed in U.S. Pat. No. 8,978,530 has operated with a good deal of success, the inventors have endeavored to develop a cutting wheel employing magnets, and wherein faster processing speeds may be achieved, and higher reliability gained than what is possible in the prior art device as shown in U.S. Pat. No. 8,978,530. Therefore, the principal object of the present invention is to provide an improvement to the cutting apparatus as disclosed in U.S. Pat. No. 8,978,530 and which provides enhanced performance and other operational characteristics not possible heretofore in a device such as what has been described in this, and previous U.S. patents.

SUMMARY OF THE INVENTION

A first aspect of the present invention relates to a cutting apparatus which includes a cutter knife supported for reciprocal movement along a path of travel, and wherein the path of travel has a first end which locates the cutter knife in a retracted, non-cutting position, and a second end, and which locates the cutter knife in an extended, cutting position; a source of fluid pressure selectively delivered to the cutter knife to move the cutter knife along the path of travel from the first end to the second end; a track member positioned adjacent to, and mechanically cooperating with the cutter knife, and which is effective in defining, at least in part, the reciprocal movement of the cutter knife along the path of travel; and a magnet mounted on the track member and which is effective in magnetically attracting and restraining the cutter knife when the cutter knife is solely at the first end of the reciprocal path of travel.

Another aspect of the present invention relates to a cutting apparatus which includes a cutter knife which has a leg shaped main body with a foot-shaped first end, and wherein the foot-shaped end defines a blade, and a leg shaft extends from the first end, and terminates at a second end, and wherein the cutter knife further has a cam follower which extends perpendicularly, outwardly, relative to the leg shaft, and wherein the cam follower has a given length dimension, and wherein the cutter knife is supported for reciprocal movement along a path of travel which has a first end which locates the cutter knife in a retracted, non-cutting position, and a second end, and which locates the cutter knife in an extended, cutting position; a knife support member which defines at least one cutter knife station, and which reciprocally supports the cutter knife when the cutter knife moves along the path of travel; a source of fluid pressure which is selectively delivered to the second end of the cutter knife, and which moves the cutter knife along the path of travel from the first end to the second end thereof; a track member positioned adjacent to the knife support member, and wherein the track member further cooperates with the cam follower of the cutter knife, and is further effective in defining, at least in part, the reciprocal movement of the cutter knife along the path of travel; and a magnet mounted on the track member, and which is effective in magnetically attracting and restraining the cutter knife when the cutter knife is at the first end of the reciprocal path of travel, and wherein the magnet has a first and second portion which are arcuately shaped, and which are further spaced a given distance apart, and wherein the first and second portions of the magnet have a substantially uniform width dimension, and emit a substantially uniform magnetic force.

These and other aspects of the present invention will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. patent Laws "to promote the progress of science and useful arts" (Article 1, Section 8).

Figure 1:
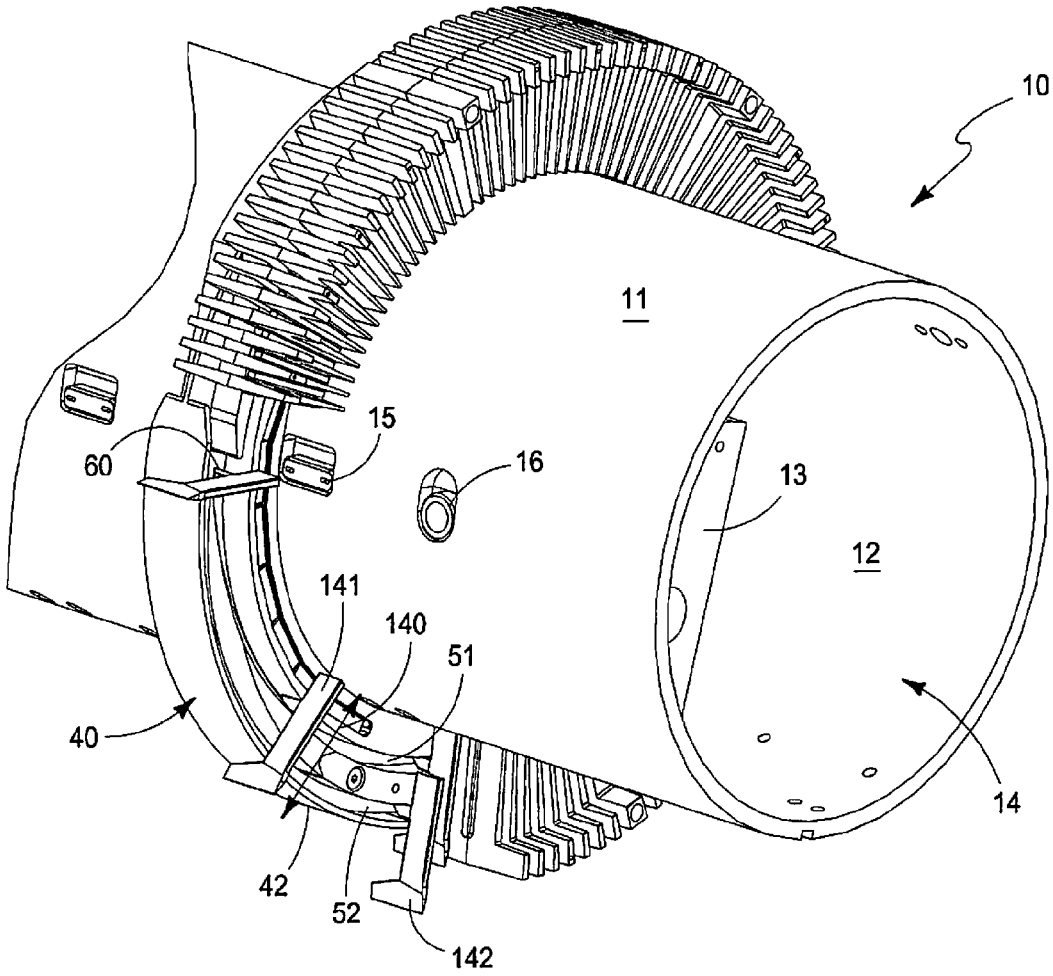
FIG. 1 is a perspective, fragmentary view of a cutting apparatus of the present invention, and which shows the location of the cutting knives in various orientations relative to the present cutting apparatus.

Referring now to a study of FIG. 1, it will be seen that the cutting apparatus 10 of the present invention includes a non-rotatable axle or support member which is generally indicated by the numeral 11. The non-rotatable axle defines an internal cavity 12 which encloses some structural features of the prior art cutting apparatus as described earlier in this application, and which are not directly germane to the present invention, but which are more fully disclosed in U.S. Pat. No. 4,520,702. Readers are referred to the aforementioned patent to understand the structure of the axle employed in this invention and only partially illustrated in this drawing. In particular, the present invention 10, and more particularly the internal cavity 12 of the fixed axle 11 encloses an ejector manifold assembly 13 which is only illustrated fragmentarily in FIG. 1. This ejector manifold assembly 13 is well known, and further disclosure and discussion regarding this assembly is unwarranted. The internal cavity 12 of the present invention is also provided with a source of fluid pressure 14 which is supplied to the ejector manifold assembly 13. This source of fluid pressure which typically comprises compressed air, travels down the internal cavity 12 and then is delivered to the ejector manifold assembly 13 and is then selectively released by valve assemblies (not shown) by way of ejector nozzles 15 as seen in FIG. 1. This fluid pressure is applied to or against the respective cutting knives so as to move them from a first non-cutting position to a second cutting position. This path of travel of the cutting knives will be discussed in greater detail, hereinafter. Readers are referred to U.S. Pat. No. 4,520,702 for details regarding the valve assemblies employed to selectively release fluid pressure to the cutting knives that will be described, hereinafter. As earlier noted the substance of U.S. Pat. Nos. 4,520,702 and 8,978,530 are both incorporated by reference into this application. The axle or support member 11 also mounts an inductive index sensor 16 which is employed to determine the orientation of the rotating knife support member which will also be discussed in greater detail hereinafter.

Figure 2:
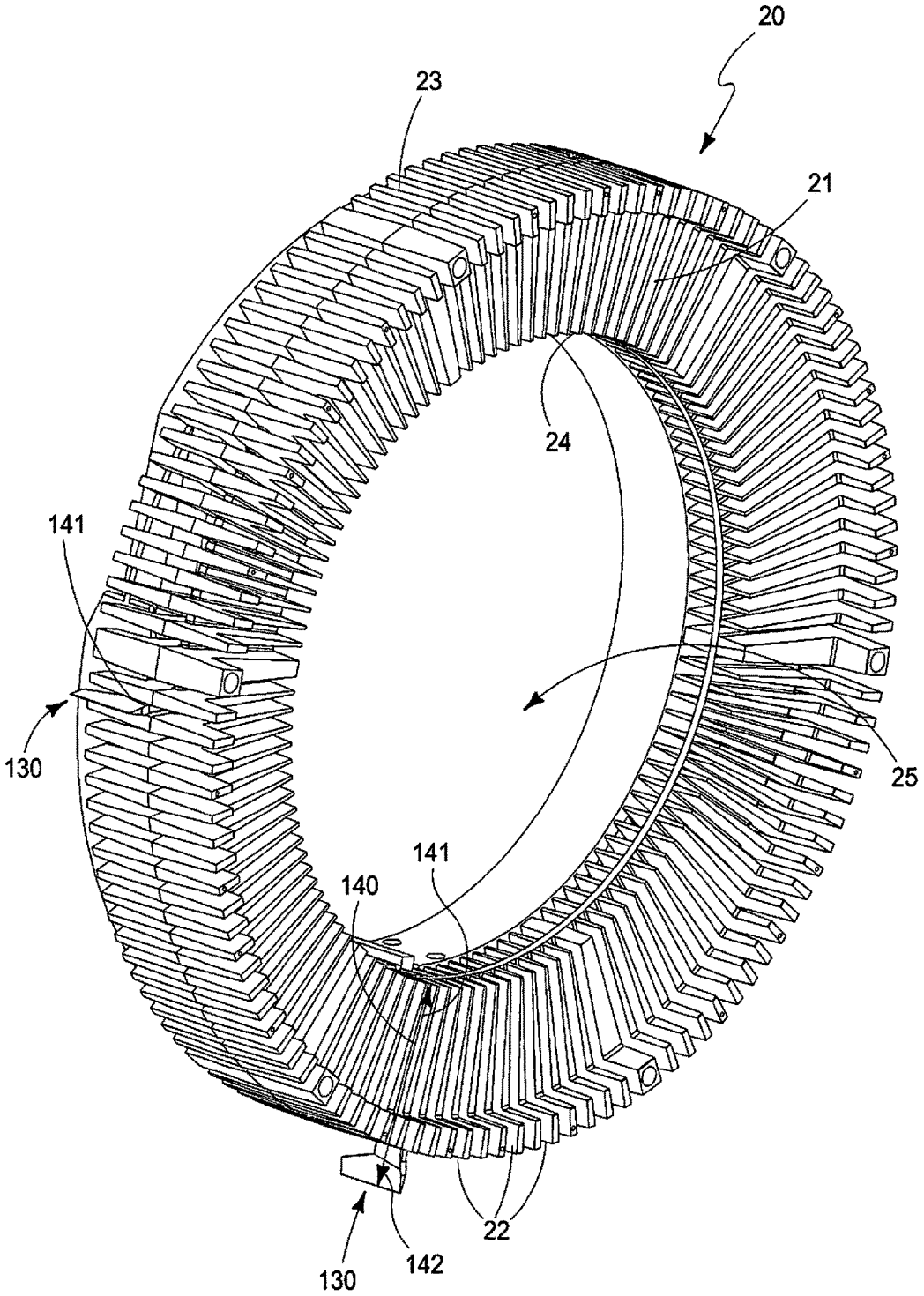
FIG. 2 is a perspective, side elevation view of a knife support ring employed with a cutting apparatus of the present invention, and which shows one cutting knife employed with the invention and which is positioned in a location which is radially, outwardly relative thereto.

A circular knife support ring 20 which is similar in structure to that described in the above-identified U.S. patents is employed in the cutting apparatus 10 of the present invention. (FIG. 2). The circular knife support ring 20 has a main body 21 which defines a plurality of cutter knife stations 22. The cutter knife stations allow the respective cutter knives as will be described, hereinafter, to be positioned in a predetermined annularly spaced relationship one relative to the others. This circular knife support ring further has an outside peripheral edge 23, and an opposite inside peripheral edge 24 which defines an aperture 25 of given dimensions. As seen in FIG. 2, the aperture 25 is sized to be just slightly larger than the outside diametral dimension of the fixed axle 11. The circular knife support ring 20 is operable to be drivingly rotated at a given operational speed about the fixed axle member 11 so as to position individual cutter knife stations in substantial alignment, and in fluid receiving relation relative to selective ejector nozzles 15 as seen in FIG. 1. As seen in the perspective side elevation view of FIG. 2, the plurality of cutter knife stations 22 are fixed or arranged into several segments which are spaced at approximately 60° orientations about the peripheral edge 23 of the main body 21. The inductive index sensor 16 (FIG. 1) is employed to verify the orientation of the knife support ring or member 20 as it rotates about the non-rotatable axle or support member 11. Further detail regarding the construction and rotation of the circular knife support ring can be found by reference to U.S. Pat. No. 4,520,702. Referring now to FIG. 1, and also to FIGS. 4, 5 and 6 the cutting apparatus 10 generally includes an annular shaped track member 40 which is immovably mounted on the axle 11, and is further juxtaposed relative to the circular knife support ring 20 as discussed, above. The annular track member as seen in the drawings (FIGS. 4 and 5), has a main body 41 which is defined by an outside, substantially circular peripheral edge 42; and an opposite inside peripheral edge 43 which further defines an aperture 44 which has a diametral dimension which is just slightly greater than the outside diametral dimension of the fixed axle or support member 11 upon which it is mounted. The annular track member 40 further defines a first substantially circular track or race 51 which is located in predetermined, spaced relation and radially inwardly relative to the outside peripheral edge 42. The first track or race 51 has a substantially uniform width and depth dimensions, and is further operable to mechanically cooperate with a feature or a portion of the respective cutter knifes which will be discussed in the paragraphs which follow.

As seen in the drawings, mentioned above, it should be understood that the annular track member 40 further defines a second arcuately shaped track or race 52 which has a first end 53 which diverges from the first circular track 51, and further has a second or converging end 54 which rejoins the first circular track at a predetermined location which is spaced from the first end 53.

Figure 5:
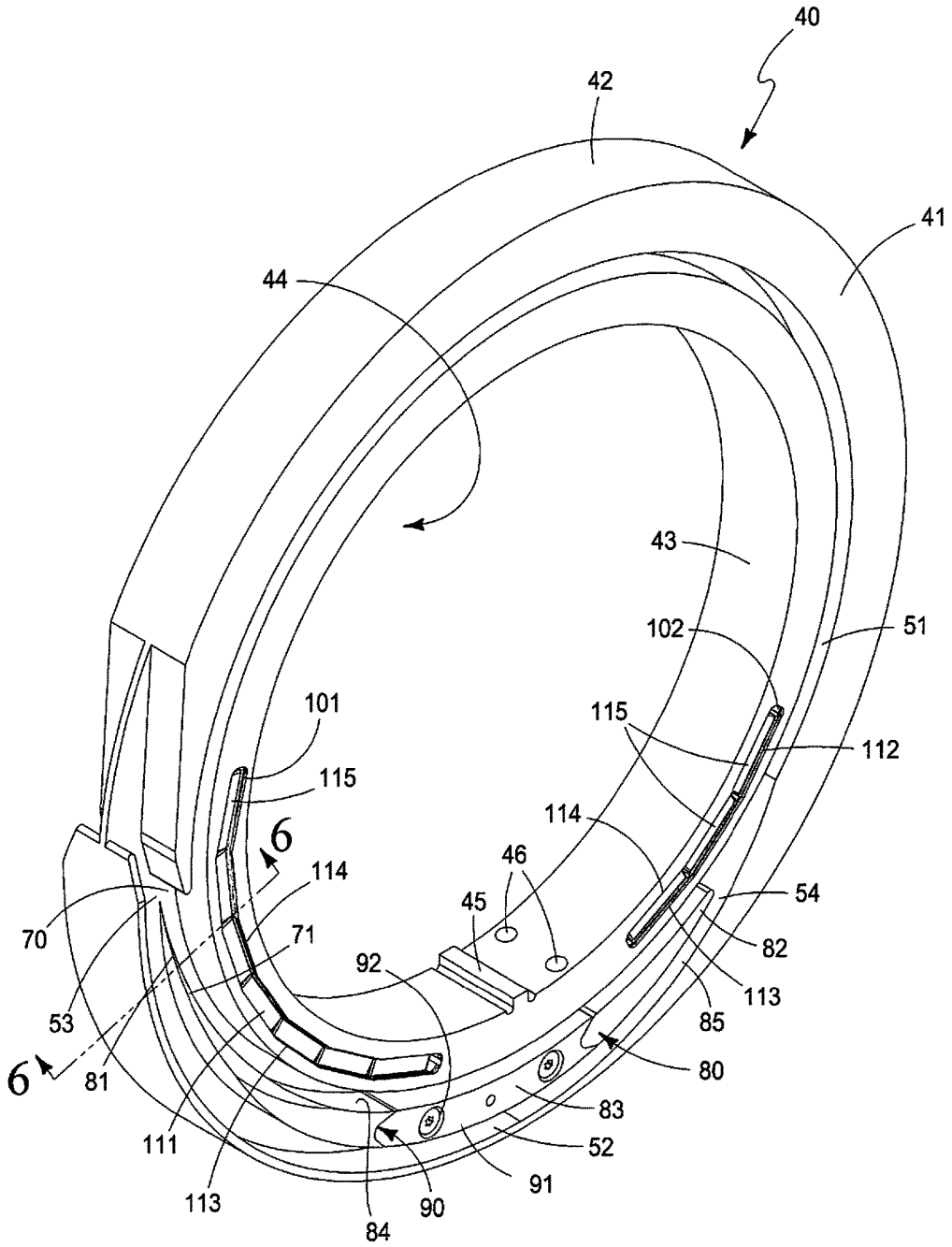
FIG. 5 is a fragmentary, perspective, side elevation view of a track member as seen in FIG. 4, with the cutting knives removed to show the structure thereunder.
Figure 6:
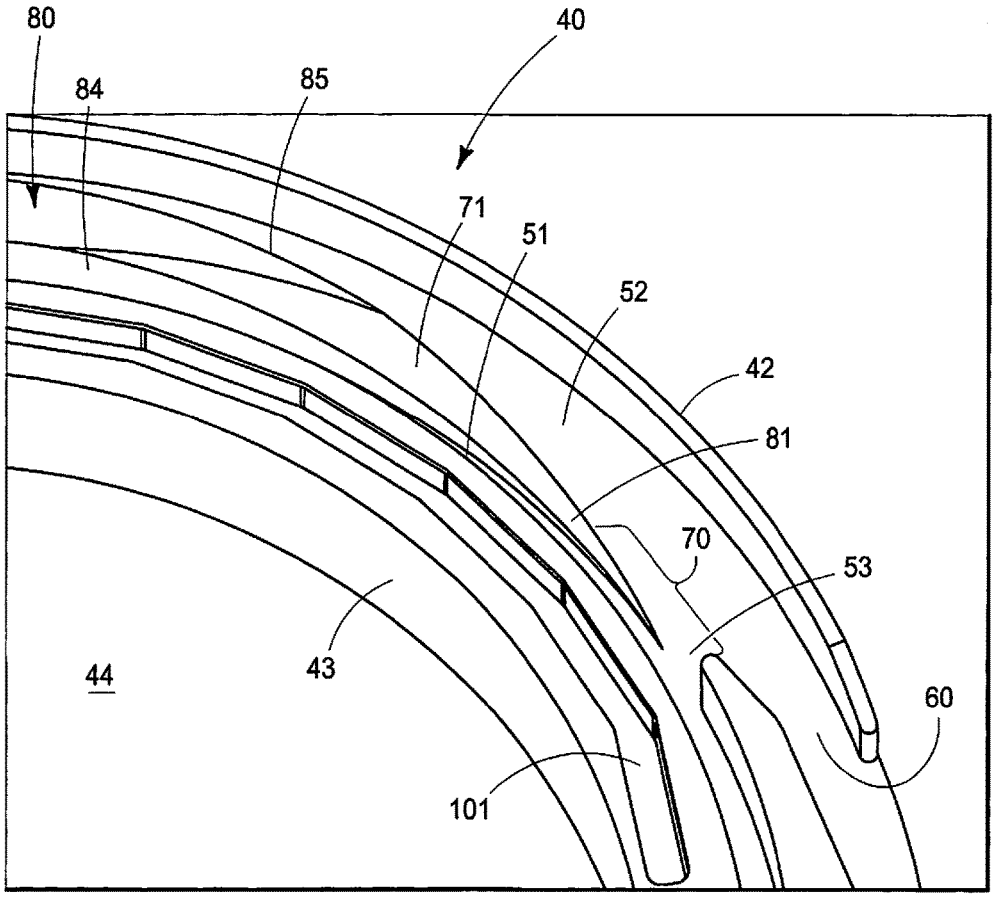
FIG. 6 is a greatly enlarged, fragmentary, perspective, plan view taken from a position along line 6-6 as seen in FIG. 5.

Referring now to FIGS. 5 and 6, it should be noted that the second track 52 does not have a substantially uniform width and depth dimension but rather the first or diverging end 53 has a width and depth dimension which is quite different than the second or converging end 54, and which rejoins the first track 51. Referring now to FIG. 6, it will be noted that the main body 41 of the annular shaped track member 40 defines a cutter knife removal region 60 which extends from the outside peripheral edge 42, and communicates with the second track 52 at a location which is near where the second track 52 diverges from the first track 51. This cutter knife removal region is employed when individual cutter knives, as will be described, hereinafter, are removed from the annular shaped track member 40 when they are damaged or other maintenance is required. Referring still to FIG. 6 a region or area generally indicated by the numeral 70 is located in the vicinity of where the second track 52 diverges from the first track 51. This first end of the second track is indicated by the numeral 53. The region 70 is defined by the annular shaped track member 40, and the main body thereof 41. This area 70, which has a variable height dimension, allows a cutter knife moving along a path of travel, and which will be discussed, hereinafter, to move smoothly from the first track 51, and into the second track 52 in a manner which substantially prevents the cutter knife from colliding with this region or area 70 during operation, and further allows for the movement of the cutter knife, as described hereinafter to be gently directed into either the first or second track during a malfunction. The region 70 also may also function, as will be described, below, to impede the bouncing or the returning of the cutter knife back into the first track 51 after the cutter knife has been deployed to cut an underlying sliced potato, not shown. The dimensions of this region 70 where the cutting knife path of travel extends will be discussed in greater detail in the paragraphs which follow.

The annular shaped track member 40, and the main body 41, thereof, defines, in part, an intermediate region 80 which is located between the first and second tracks 51 and 52, respectively, and further defines, in part, portions of the first and second track 51, 52 as described hereinafter (FIG. 5). The curved or arcuately shaped intermediate region has a first end 81, an opposite second end 82, and a midpoint which is generally indicated by the numeral 83. As can be seen from FIGS. 6 and 7 the intermediate region has a diminishing width dimension when measured from the midpoint 83, and in the direction of the first and second ends thereof 81 and 83, respectively. Still further, the intermediate region 80 has a height and width dimension which diminishes when measured in a direction extending from the midpoint 83, and towards the first end 81 thereof. Referring now to FIG. 6 the first end 81 of the intermediate region 80 is defined by a radially inwardly oriented surface 71 that is oriented in about a 45 degree angle relative to the mid-plane of the intermediate region, and is otherwise helically oriented. The helical orientation would typically cause a rise or elevation gain of about 4.14 inches for a full 360 degree rotation of the track member 40. In the present invention the rise or increase in length or elevation of the first end 81 is about 0.562 inches when the track member rotates about 48.1 degrees around the circumferences of the track member. The region 70 partially overlays, and transversely extends in a radial direction across the first end 81 of the intermediate region 80. This arrangement allows the respective cutter knives, as will be disclosed, to pass over the extreme distal end of the first end 81 until the elevation of the first end 81 reaches a height where the cam follower of the cutter knife engages the first end 81. Still further the intermediate region 80 has a substantially uniform height dimension when measured from the midpoint 83, and in the direction of the second end 82 thereof. The intermediate region is defined, in part, by a radially inwardly disposed and curved sidewall 84 which forms, or defines, in part, a portion of the first track 51, and additionally defines a radially outwardly disposed, and curved sidewall 85 which defines or forms, in part, a portion of the second track 52. As seen in the drawings (FIG. 5), the intermediate region 80 defines a cavity 90 which is located in the region of the midpoint 83. The cavity has a predetermined shape and is operable to matingly receive a camming insert which is generally indicated by the numeral 91. The releasable, curved, camming insert 91 matingly cooperates with, and forms a portion of the respective curved sidewalls 84 and 85 of the intermediate region 80. As should be understood the track member 40 is fabricated from a first machinable and/or moldable material having a predetermined hardness, durability, and/or functional usefulness and compatibility when used with the material which forms the cutter knives as discussed below; and the curved, camming insert is fabricated, at least in part, of a second material which has a hardness, durability, and/or functional usefulness and compatibility which is typically greater than the first material. The camming insert 91 is secured in the cavity 90 by fasteners 94. The camming insert 91 is provided is a "wear part" which can be removed, and replaced during the use of the present invention so as to extend the useable lifetime of the product. The frictional wear which causes this camming insert 91 to be replaced will be discussed in more detail, hereinafter. Of course the track member 40 can be fabricated of a single material which resists this frictional wear while remaining functionally compatible with the material which is used to fabricate the respective cutter knives as described, hereinafter. If the above mentioned manufacturing option was selected the camming insert would typically no longer be necessary.

Figure 4:
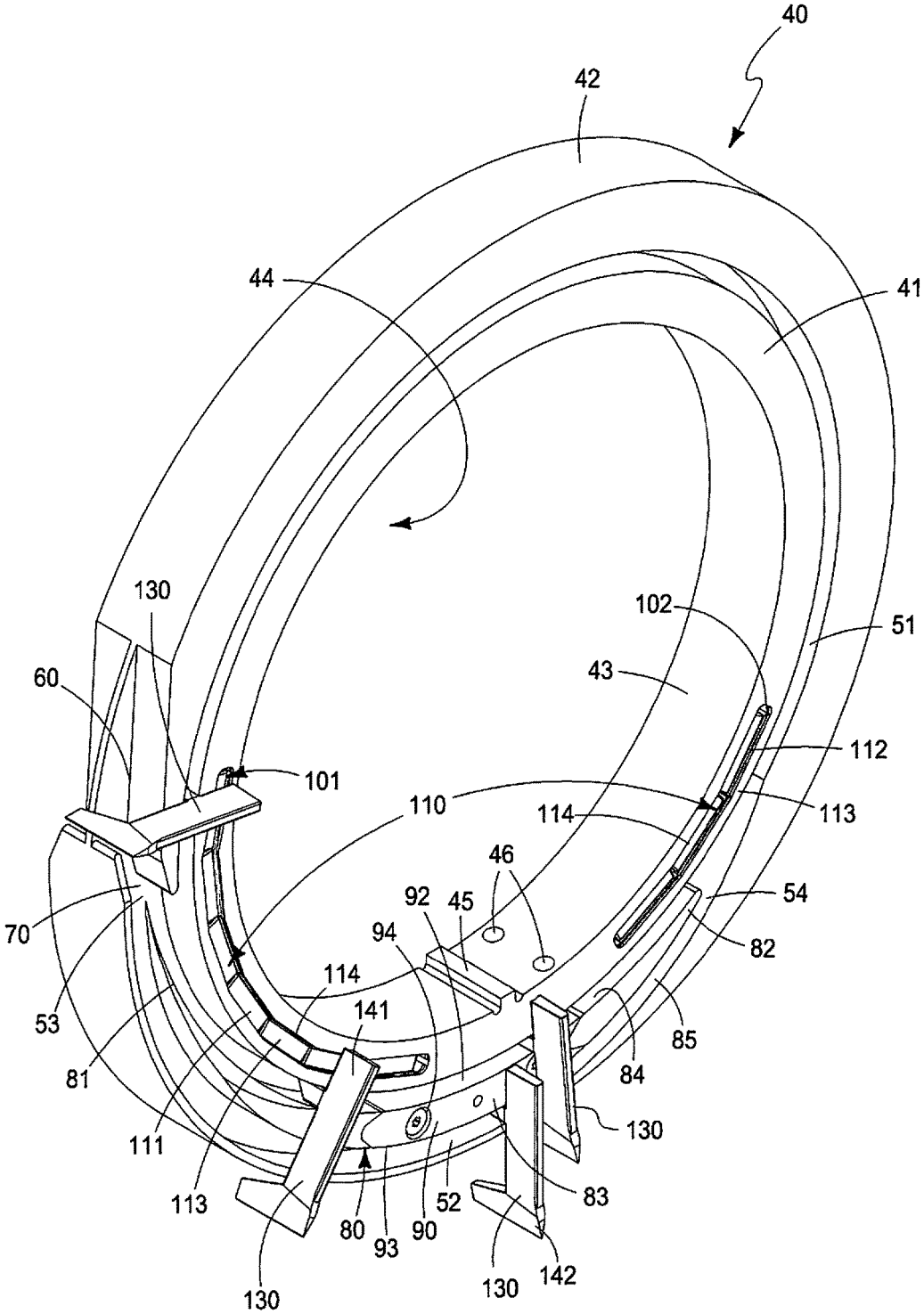
FIG. 4 is a fragmentary, perspective, side elevation view of a track member which forms a feature of the present invention, and which further illustrates cutting knives positioned in various orientations about the track member.

Referring now to FIGS. 4, 5 and 6 the main body 41 of the annular shaped track member 40 defines, in part, a first magnet cavity 101, and a second magnet cavity 102. The first and second magnet cavities are positioned radially, inwardly, relative to the first track 51, and the first magnet cavity 101 is located in the vicinity of the main body 41 and adjacent to where the second track 52 diverges from the first track 51. Still further the second magnet cavity 102 is located in the region of the main body 41, and where the second track 52 converges back with the first substantially circular shaped track 51. The first and second magnet cavities 101 and 102, respectively, are arcuately shaped and have a curvature which is substantially similar to the curvature of the substantially circular shaped first track 51. As noted, above, the first and second magnet cavities 101 and 102 are located in juxtaposed, spaced relation, and radially inwardly relative to the first track 51. It should be understood that the substantially circular shaped first track 51 has a circumferential dimension, and the first magnet cavity 101 occupies less than about 86° of circumference of the first track. Still further the second portion of the magnet cavity 102 occupies less than about 37° of the circumference of the first track 51. It should be understood that the first magnet cavity 101 is spaced from the second magnet cavity 102 by less than about 40° of circumference of the first track 51. A magnet which is generally indicated by the numeral 110 is received within the respective first and second magnet cavities 101 and 102, respectively. The magnet 110 includes a first portion 111, which is arcuately shaped, and which is matingly received within the first magnet cavity 101, and the second portion of the magnet 112 is also arcuately shaped, and is matingly received within the second magnet cavity 102. The respective magnet portions each have a north pole 113, and a south pole 114. In the arrangement as seen in the drawings the north pole 113 is located in a juxtaposed, closely spaced relationship relative to the first track 51; and the south pole 114 is located radially, inwardly, and in spaced relation relative to the first track 51. As should be understood the first and second portion of the magnets 111 and 112 can be fabricated as a single piece, or and as illustrated in FIG. 5 can be formed by a multitude of individual smaller elongated magnets and which are juxtaposed, end-to-end relative to each other. As should be understood, the first and second portions of the magnet 111 and 112, each exerts a magnetic force which is uniform along the length thereof. The magnetic force exerted by each of the first and second portions of the magnet 111 and 112, respectively, is directed substantially radially inwardly relative to the first track 51. The operation of the first and second portions of the magnet 111 and 112, respectively will be discussed in greater detail in the paragraphs which follow.

Figure 3:
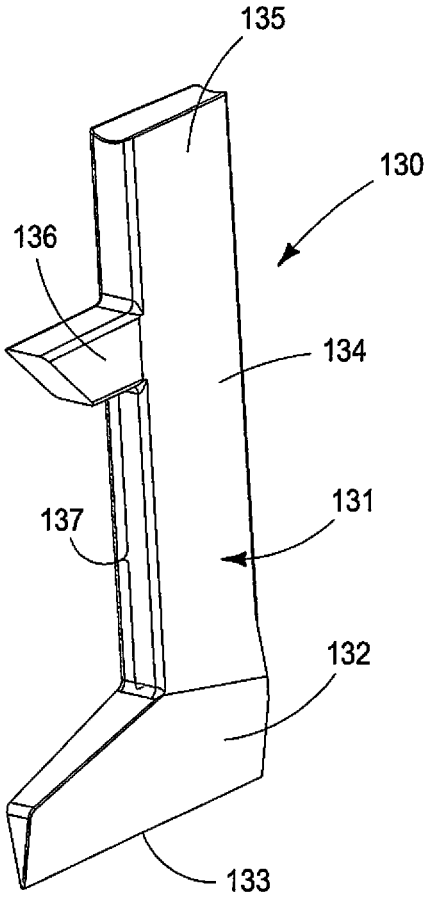
FIG. 3 is a perspective, side elevation view of one form of a cutting knife which may be employed in the cutting apparatus of the present invention.

Referring now to FIGS. 1, 3 and 4, the cutting apparatus 10 of the present invention employs a plurality of cutter knives which are generally indicated by the numeral 130, and which are further selectively, and reciprocally moveable along a given radially oriented path of travel which will be discussed, below, from a first non-cutting position to a second radially extended cutting position relative to the substantially circular knife support ring 20, and the annular track member 40, within which the cutter knives mechanically cooperate. More specifically the respective cutter knives 130, as best seen in FIG. 3 has a leg shaped main body 131 which has a first, foot shaped end 132, and a blade like edge 133 which is utilized to cut an object of interest such as vegetables of various sorts and which are being processed (not shown). The respective cutter knives 130 include a leg shaft 134, and which extends from the first foot shaped end 132, and terminates at a second end 135. The source of fluid pressure 14, as earlier discussed, is applied to the second end 135 and is the force which propels the respective cutter knives 130 along the path of travel, as will be discussed below. Still further a projection or cam follower 136 is made integral with the leg shaft 134 and extends normally outwardly relative thereto, and is disposed in the same plane as the first foot shaped end 132. The projection or cam follower 136 is operable to be received in, move along, and otherwise mechanically cooperated with either the first circular track 51, or the second track 52, and which is defined by the annular track member 40. The cam follower 136 is located approximately midway between the first end 132, and the second end 135. The cam follower has a given length dimension. The length of the cam follower determines, at least in part, the width of the region 70. As the length of the cam follower increases, the width of the region 70 becomes narrower. On the other hand, as the length of the cam follower gets shorter, the width of the region 70 increases. The width of the region 70 determines, at least in part, the speed of operation of the cutting apparatus 10 because a wider region 70 will sometimes permit enough time to elapse, once a cutting knife is propelled along the path of travel, so that the cutting knife can reach the end of the course of travel and bounce back in the direction of the first track 51. By shortening the width of the region 70, the respective cutter knives which are propelled along the course of travel can be reliably retained in the second track 52, and cannot bounce or move back into the first track 51. The movement of one of the respective cutter knives 130 into these earlier described individual tracks 51 or 52 defines, at least in part, a reciprocal course of travel 140 for the individual cutter knives 130. As seen in FIG. 3, a gap 137 is defined between the first foot shaped end 132, and the projection or cam follower 136. This gap defines the length of the course of travel 140 of the respective cutter knives 130. The present cutter knife 130 is substantially similar in its overall shape to the cutter knife as described in U.S. Pat. No. 4,520,702 which is incorporated by reference herein. Further, the respective cutter knives 130 are received, and slidably supported in individual cutter knife stations 22 as defined by the circular knife support ring 20, and which further defines, at least in part, the course of travel of the respective cutting knives 130. Therefore the cutter knives 130 move along a course of travel or path of travel 140 from a first end 141 (FIG. 1) and wherein at the first end, the cutter knife 130 is located in a retracted non-cutting position, and continues to move or travel along the first track 51, to a second end 142 of the path of travel 140, and where the individual cutter knives 130 are located in an extended cutting position, and the respective cutter knives 130 are moving along the second track 52. As should be understood, the selective application of the source of fluid pressure 14 is effective to move the individual cutter knives 130 through the region 70 of the track member (FIG. 6) from the first track 51, into the second track 52 thereby moving the cutter knife along the path of travel 140 from the first end 141 of the path of travel 140, and wherein the cutter knife 130 is in a retracted non-cutting position to the second end 142 of the path of travel and where the cutter knife is in the extended cutting position and is traveling along the second track 52. It should be apparent from studying the drawings (FIG. 1), the movement of the individual cutter knives 130 is effected at least in part by the cam follower 136 which moves or is guided along the respective first, and second tracks in the manner which was described in the earlier paragraphs and references cited. It should be appreciated from a study of FIG. 4 that the individual cutter knives 130 which are in the extended cutting position at the second end 142 of the path of travel 140 is in a location typically where the individual cutter knives 130 are engaging an object to be severed such as a French fry, elongated vegetable or the like (not shown). When individual cutter knives are forcibly engaging the object to be cut, the engagement with the object causes the individual cutter knives 130 to be urged radially inwardly, and the projection or cam follower 136 frictionally engages or comes into engagement with the camming insert 91. This radially inwardly directed force, and frictional engagement causes, over time, frictional wear or deterioration in the region of the midpoint 83 of the intermediate region of the main body 41. Consequently, the camming insert 91, and more specifically the second sidewall 93, is fabricated of a substance, as noted above, which has a hardness, durability and/or functional compatibility, hereinafter referred to as a "wear factor", which is greater than the "wear factor" as calculated for the material which forms the main body 41 of the annular shaped track member. Again these materials are chosen to be functionally compatible with the material chosen to fabricate the cutter knifes as discussed, below. Consequently, a frictionally worn intermediate region 80, and which is occupied by the camming insert 91, can be easily replaced so as to maintain the present invention 10 in operation for a prolonged period of time.

In the arrangement as seen in the drawings, it should be appreciated that the first and second portions of the magnet 111 and 112, respectively, are operable to magnetically restrain the individual cutter knives 130 in the first track 51 in the absence of the application of selective fluid pressure 14 which would urge the individual cutter knives 130 along the reciprocal path of travel 140 from the first end 141 to the second end 142 as described, above. Further, and with regard to the second portion 112 of the magnet 110, this magnet 112 is operable not only to magnetically attract cutter knives 130 which are converging with the first track 51 after traveling along the second track 52, but further is operable to prevent inadvertent movement of cutter knives moving along the first track 51 to a location spaced from the first track because of the gap or space presented by the convergence of the first and second tracks at the second end 82 of the intermediate region 80. This movement might be caused by the effect of centrifugal force acting on the respective cutting knives. In addition to this function, the second portion 112 of the magnet 110 also functions to retain the cutter knives in the first track 51 when the cutting apparatus is rotated backwards when a user is clearing a malfunction, or removing broken or damaged cutting knife. It should be appreciated that the individual cutter knives 130 are formed, at least in part, of a material which is magnetically attracted by the first and second portions of the magnet 110. The magnetic force exerted by the first and second portions of the magnet 111 and 112 respectively principally attract the projection or cam follower 136 in contrast to the teachings of the earlier prior art patent where the magnet was effective to attract both the projection as well as the foot shaped end of the cutter knife. The preferred form of the cutter knives 130 are typically fabricated from nylon which has a filler material formed of a small percentage of a magnetically attractive metal which allows the respective cutter knives to magnetically cooperate with the magnet 110 as described, above. Stainless steel may also be employed. The respective cutter knives 130 and have a length dimension of about 55 mm, and a thickness of about 1.5 mm.

Operation

The operation of the described embodiment of the present invention is believed to be readily apparent and briefly summarized at this point.

In its broadest aspect the present invention 10 relates to a cutting apparatus which includes a cutter knife 130 which is supported for reciprocal movement along a path of travel 140. The path of travel 140 has a first end 141 which locates the cutter knife 130 in a retracted, non-cutting position, and a second end 142 and which locates the cutter knife in an extended, cutting position. The present invention includes a source of fluid pressure 14 which is selectively delivered to the cutter knife 130 to move the cutter knife 130 along the path of travel 140 from the first end to the second end 141 and 142 respectively. The present invention 10 also includes a track member 40 which is positioned adjacent to, and mechanically cooperates with the cutter knife 130, and which is further effective in defining, at least in part, the reciprocal movement of the cutter knife along the path of travel 140. Further, and in its broadest aspect, the present invention 10 includes a magnet 110 which is located on the track member 40, and which further is effective in magnetically attracting, and restraining, the cutter knife 130 when the cutter knife is at the first end 141 of the reciprocal path of travel 140. In its broadest aspect the track member 40 has a generally circular shape main body 41 which defines a circumscribing peripheral edge 42. The main body 41 further defines a first substantially circular shaped track 51 which is located in a radially inwardly spaced relationship relative to the circumscribing peripheral edge 42 of the main body 41. A second, arcuately shaped track 52 communicates with the first track 51, and is further located in a region of the main body 41 which is between the first track and the circumscribing peripheral edge 42. The magnet 110 is located in juxtaposed, radially inwardly spaced relation relative to the first substantially shaped track 51.

The second, arcuately shaped track 52 has a first end 53 which diverges in a radially outward direction away from the first track 51, and towards the circumscribing peripheral edge 42 of the main body 41. Still further the second track 52 has an opposite second end 54, and which converges with the first track 51, and further is oriented in a generally radially inward direction, and away from the circumscribing peripheral edge 42 of the main body 41. The cutter knife 130 when traveling along the first track 51 remains in the first, retracted or non-cutting position 141, and upon the selective application of fluid pressure 14 to the cutter knife 130, the cutter knife 130 diverges from the first track 51 and into the second track 52, and is further carried along the path of travel 140 into the second extended cutting position 142 and then travels or otherwise returns back to the first non-cutting position 141 when the cutter knife 30 moves along the second track and then converges with the first track 51. This movement of the cutter knife 130 is effected by the rotation of the knife support ring 20 relative to the non-rotatable axle 11 as earlier disclosed in this reference, and in the earlier patents.

In its broadest aspect the cutting apparatus 10 includes a magnet 110 which is oriented, at least in part, in a region of the circular shaped main body 41 where the second track 52 diverges from, and then converges back with the first substantially circular shaped track 51. As earlier discussed, the magnet 110 has a first and second arcuately shaped portion 111 and 112 respectively. Each portion of the magnet has a substantially uniform width dimension. Still further, the first track 151 has a circumferential dimension and the first portion 111 of the magnet 110 occupies less than about 86° of the circumference of the first track. Further, the second portion 112 of the magnet 110 occupies less than about 37° of the circumference of the first track 51. It should be understood that the first portion 111 of the magnet 110 is spaced from the second portion 112 of the magnet 110 by less than about 40° of the circumference of the first track 51. The first and second portions of the magnet 111 and 112, respectively, each exerts a magnetic force which is uniform along the length thereof. The magnetic force exerted by each of the first and second portions 111 and 112 of the magnet 110 is directed substantially radially inwardly relative to the first track 51. In the arrangement as seen in the drawings the first and second portions of the magnet 111 and 112 respectively each has a north and southpole labeled 113 and 114 respectively. The northpole 113 is located in a juxtaposed, closely spaced relationship relative to the first track 51; and the southpole 114 is located radially inwardly, and in spaced relation relative to the first track 57. The first and second portions of the magnet 111 and 112, respectively, in one form of the invention are formed of a plurality of magnets 115 which are juxtaposed, end-to-end relative to each other. As earlier discussed the cutter knife 130 is formed, at least in part, of a metal which is magnetically attracted by the first and second portions of the magnet 111 and 112 respectively.

In its broadest aspect, the first and second tracks, 51 and 52, as defined by the annular shaped track member 40, each have a given width, and depth dimension, and are defined, at least in part, by an intermediate region 80 of the circular shaped main body 41, and which is located between the respective first and second tracks 51 and 52, respectively. The intermediate region 80 of the main body 40 has opposite first and second ends 81 and 82, respectively, and a midpoint 83 which is located between the first and second ends. The intermediate region has a diminishing width dimension when measured from the midpoint 83, and in the direction of the first and second ends 81 and 82 thereof. The intermediate region 80 has a height dimension which diminishes when measured in a direction extending from the midpoint and towards the first end thereof, and a substantially uniform height dimension when measured from the midpoint 83 and the direction of the second end 82 of the intermediate region 80.

The intermediate region 80 is further defined by opposite curved sidewalls 84 and 85 respectively. Each of the curved sidewalls have a different degree of curvature, and the immediate region 80 further defines a cavity 90 which matingly receives a releasable, curved camming insert 90. The camming insert 90 cooperates with, and forms a portion of the respective curved sidewalls 84 and 85 of the intermediate region 80. The track member 40, in one form of the invention, is fabricated from a first material having a predetermined hardness, durability and/or functional compatibility, hereinafter defined as a wear factor. Further, the curved camming insert 90, is fabricated, at least in part, of a second material which has a wear factor which is greater than or more desirable than the first material. In the present invention, the path of travel 140 of the respective cutting knives 130 extends through an area of the circular main body 70 where the second track 52 diverges from the first track 51. The area where the path of travel 140 extends has a width dimension of less than about 30 mm. In the present arrangement the invention 10 includes a cutter knife removal region 60 which is defined by the circular shaped main body 41, and which extends from the peripheral edge 42 thereof and communicates with the second track 52 at a location which is near where the second track 52 diverges from the first track 51.

Therefore it will be seen that the cutting apparatus of the present invention provides a convenient means whereby the perceived shortcomings in the performance of the prior art device as seen in U.S. Pat. No. 4,520,702 are effectively overcome and thereby provides a cutting assembly having an increased robustness and reliability exceeding that which has been experienced, heretofore. The invention further provides increased operating speeds over that which may be achieved by utilizing the apparatus as seen in U.S. Pat. No. 8,978,530. As noted above, the teachings of both of these patents are incorporated by reference, herein.

In compliance with the statute, the invention has been described in language more or less specific as to structural and methodical features. It is to be understood, however that the present invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the Doctrine of Equivalence.

We claim:

1. A cutting apparatus comprising:

a cutter knife supported for reciprocal movement along a path of travel, and wherein the path of travel has a first end which locates the cutter knife in a retracted, non-cutting position, and a second end, and which locates the cutter knife in an extended, cutting position;

a source of fluid pressure selective delivered to the cutter knife to move the cutter knife along the path of travel from the first end to the second end;

a track member positioned adjacent to, and mechanically cooperating with the cutter knife, and which is effective in defining, at least in part, the reciprocal movement of the cutter knife along the path of travel;

a magnet mounted on the track member and which is effective in magnetically attracting and restraining the cutter knife when the cutter knife is at the first end of the reciprocal path of travel; and wherein the track member has a generally circular shaped main body which defines a circumscribing peripheral edge, and wherein the main body further defines a first, substantially circular shaped track which is located in a radially inwardly spaced relationship relative to the circumscribing peripheral edge of the main body; and a second, arcuately shaped track which communicates with the first track, and which is further located in a region of the main body which is between the first track, and the circumscribing peripheral edge, and wherein the magnet is located in juxtaposed, radially inwardly spaced relation relative to the first substantially circular shaped track.

2. A cutting apparatus as claimed in claim 1, and wherein the second, arcuately shaped track has a first end which diverges in a radially outward direction away from the first track, and towards the circumscribing peripheral edge of the main body, and an opposite, second end, and which converges with the first track, and further is oriented in a generally radially inward direction, and away from the circumscribing peripheral edge of the main body, and wherein the cutter knife, when traveling along the first track remains in the first, retracted, non-cutting position, and wherein upon the selective application of fluid pressure to the cutter knife, the cutter knife diverges from the first track, and into the second track, and is further carried along the path of travel into the second, extended cutting position, and then travels back to the first non-cutting position when the cutter knife moves along the second track and then converges with the first track.

3. A cutting apparatus as claimed in claim 2, and wherein the magnet is oriented, at least in part, in a region of the circular shaped main body where the second track diverges from, and then converges back with, the first substantially circular shaped track.

4. A cutting apparatus as claimed in claim 3, and wherein the magnet has a first and second arcuately shaped portion, and wherein each portion of the magnet has a substantially uniform width dimension.

5. A cutting apparatus as claimed in claim 4, and wherein the first track has a circumferential dimension, and the first portion of the magnet occupies less than about 86 degrees of circumference of the first track; and the second portion of the magnet occupies less than about 37 degrees of circumference of the first track.

6. A cutting apparatus as claimed in claim 5, and wherein the first portion of the magnet is spaced from the second portion of the magnet by less than about 40 degrees of circumference of the first track.

7. A cutting apparatus as claimed in claim 5, and wherein the first and second portions of the magnet each exerts a magnetic force which is uniform along the length thereof, and wherein the magnetic force exerted by each of the first and second portions of the magnet is directed substantially radially inwardly relative to the first track.

8. A cutting apparatus as claimed in claim 7, and wherein first and second portions of the magnet each has a north and south pole, and wherein the north pole is located in a juxtaposed, closely spaced relationship relative to the first track, and the south pole is located radially inwardly, and in spaced relation relative to the first track.

9. A cutting apparatus as claimed in claim 8, and wherein the first and second portions of the magnet are formed of a plurality of magnets which are juxtaposed, end-to-end, relative to each other.

10. A cutting apparatus as claimed in claim 8, and wherein the cutter knife is formed, at least in part, of a metal which is magnetically attracted by the first and second portions of the magnet.

11. A cutting apparatus as claimed in claim 2, and wherein the respective first and second tracks each have a given width, and depth dimension, and are defined, at least in part, by an intermediate region of the circular shaped main body which is located between the respective first and second tracks, and wherein the intermediate region has opposite first and second ends, a mid-point located between the first and second ends, and a diminishing width dimension when measured from the mid-point, and in the direction of the first and second ends thereof, and wherein the intermediate region has a height dimension which diminishes when measured in a direction extending from the mid-point and towards the first end thereof, and a substantially uniform height dimension when measured from the mid-point, and in the direction of the second end of the intermediate region.

12. A cutting apparatus as claimed in claim 11, and wherein the intermediate region is further defined by opposite, curved side walls each having a different degree of curvature, and wherein the intermediate region further defines a cavity which matingly receives a releasable, curved, camming insert which cooperates with, and forms a portion of the respective curved sidewalls of the intermediate region, and wherein the track member is fabricated from a first material having a predetermined wear factor, and wherein the curved, camming insert, is fabricated, at least in part, of a second material which has a wear factor which is greater than the first material.

13. A cutting apparatus as claimed in claim 11, and wherein the path of travel of the cutting knife extends through an area of the circular main body where the second track diverges from the first track, and wherein the area where the path of travel extends has a width dimension of less than about 30 mm.

14. A cutting apparatus as claimed in claim 11, and further comprising a cutter knife removal region which is defined by the circular shaped main body, and which further extends from the peripheral edge thereof, and communicates with the second track at a location which is near where the second track diverges from the first track.

15. A cutting apparatus, comprising:

a cutter knife which has a lea shaped main body with a foot-shaped first end, and wherein the foot-shaped end defines a blade, and a lea shaft extends from the first end, and terminates at a second end, and wherein the cutter knife further has a cam follower which extends perpendicularly, outwardly, relative to the leg shaft, and wherein the cam follower has a given length dimension, and wherein the cutter knife is supported for reciprocal movement along a path of travel which has a first end which locates the cutter knife in a retracted, non-cutting position, and a second end, and which locates the cutter knife in an extended, cutting position;

a knife support member which defines at least one cutter knife station, and which reciprocally supports the cutter knife when the cutter knife moves along the path of travel;

a source of fluid pressure which is selectively delivered to the second end of the cutter knife, and which moves the cutter knife along the path of travel from the first end to the second and thereof;

a track member positioned adjacent to the knife support member, and wherein the track member further cooperates with the cam follower of the cutter knife, and is further effective in defining, at least in part, the reciprocal movement of the cutter knife along the path of travel;

a magnet mounted on the track member, and which is effective in magnetically attracting and restraining the cutter knife when the cutter knife is at the first end of the reciprocal path of travel, and wherein the magnet has a first and second portion which are arcuately shaped, and which are further spaced a given distance apart, and wherein the first and second portions of the magnet have a substantially uniform width dimension, and emit a substantially uniform magnetic force; and wherein the track member has a generally circular shaped main body which defines a circumscribing peripheral edge, and wherein the main body further defines a first, substantially circular shaped track which is located in a radially inwardly spaced relationship relative to the circumscribing peripheral edge of the main body; and a second, arcuately shaped track which communicates with the first track, and which is further located in a region of the main body which is between the first track, and the circumscribing peripheral edge, and wherein the magnet is located in juxtaposed, radially inwardly spaced relation relative to the first substantially circular shaped track.

16. A cutting assembly as claimed in claim 15, and wherein the second, arcuately shaped track has a first end which diverges in a generally radial outward direction away from the first track, and towards the circumscribing peripheral edge of the main body, and an opposite, second end which converges with the first track, and further is located in a generally radial inward direction, and is spaced from the circumscribing peripheral edge of the main body, and wherein the cutter knife, when traveling along the first track remains in the first, retracted, non-cutting position, and wherein upon the selective application of fluid pressure to the second end of the cutter knife, the cutter knife diverges from the first track, and into the second track, and is further carried along the path of travel into the second, extended cutting position, and then travels back to the first non-cutting position when the cutter knife converges with the first track.

17. A cutting assembly as claimed in claim 16, and wherein the magnet is oriented, at least in part, in a region of the circular shaped main body where the second track diverges from, and then converges back with the first substantially circular shape track, and wherein the first track has a circumferential dimension, and the first portion of the magnet occupies less than about 86 degrees of circumference of the first track; and the second portion of the magnet occupies less than about 37 degrees of circumference of the first track; and the first portion of the magnet is spaced from the second portion of the magnet by less than about 40 degrees of circumference of the first track.

18. A cutting apparatus as claimed in claim 17, and wherein, the first and second portions of the magnet each has a north and south pole, and wherein the north pole is located in a juxtaposed, closely spaced relationship relative to the first track, and the south pole is located radially inwardly, and in spaced relation relative to the first track.

19. A cutting apparatus as claimed in claim 18, and wherein the respective first and second tracks each have a given width, and depth dimension, and are defined, at least in part, by an intermediate region of the circular shaped main body which is located between the respective first and second tracks, and wherein the intermediate region has opposite first and second ends, a mid-point located between the first and second ends, and a diminishing width dimension when measured from the mid-point and in the direction of the first and second ends thereof, and wherein the intermediate region has a height dimension which diminishes when measured in a direction extending from the mid-point and in the direction of the first end thereof, and a substantially uniform height dimension when measured from the mid-point, and in the direction of the second end of the intermediate region.

20. A cutting apparatus as claimed in claim 19, and wherein the intermediate region is further defined by opposite, curved side walls each having a different degree of curvature, and wherein the intermediate region further defines a cavity which matingly receives a releasable, curved, camming insert which cooperates with, and forms a portion of the respective curved sidewalls of the intermediate region, and wherein the track member is fabricated from a first material having a predetermined wear factor, and wherein the curved, camming insert, is fabricated, at least in part, of a second material which has a wear factor which is more desirable than the first material.

21. A cutting apparatus as claimed in claim 19, and wherein the path of travel of the cutting knife extends through an area of the circular main body where the second track diverges from the first track, and wherein the area, where the path of travel extends, has a width dimension of less than about 30 mm.

22. A cutting apparatus as claimed in claim 19, and further comprising a cutter knife removal region which is defined by the circular shaped main body, and which extends from the peripheral edge thereof, and communicates with the second track at a location which is near where the second track diverges from the first track.

* * * * *